US009117404B2

(12) United States Patent
Cho

(10) Patent No.: US 9,117,404 B2
(45) Date of Patent: Aug. 25, 2015

(54) ORGANIC LIGHT EMITTING DIODE DISPLAY DEVICE

(71) Applicant: MinSu Cho, Busan (KR)

(72) Inventor: MinSu Cho, Busan (KR)

(73) Assignee: LG Display Co., Ltd., Seoul (KR)

( * ) Notice: Subject to any disclaimer, the term of this patent is extended or adjusted under 35 U.S.C. 154(b) by 287 days.

(21) Appl. No.: 13/650,467

(22) Filed: Oct. 12, 2012

(65) Prior Publication Data

US 2013/0093748 A1 Apr. 18, 2013

(30) Foreign Application Priority Data

Oct. 12, 2011 (KR) ..... 10-2011-0104313

(51) Int. Cl.
*G09G 3/32* (2006.01)

(52) U.S. Cl.
CPC ..... *G09G 3/3225* (2013.01); *G09G 2320/0233* (2013.01); *G09G 2330/02* (2013.01); *G09G 2330/028* (2013.01)

(58) Field of Classification Search
CPC .. G06F 3/038; G09G 3/30; G09G 2320/0233; G09G 2330/02; G09G 2330/028; G09G 3/3225
USPC ..... 345/208, 211–212, 39, 46, 51–53, 55, 345/58, 82, 84; 323/312–313; 327/513–539
See application file for complete search history.

(56) References Cited

U.S. PATENT DOCUMENTS 5,604,466 A * 2/1997 Dreps et al. ..... 331/113 R
5,867,012 A * 2/1999 Tuthill ..... 323/313
7,009,545 B2 * 3/2006 Cho et al. ..... 341/155
7,307,605 B2 * 12/2007 Shimoda et al. ..... 345/76
7,863,968 B1 * 1/2011 Perisetty ..... 327/541
8,587,346 B2 * 11/2013 Kamatani ..... 327/108

(Continued)

FOREIGN PATENT DOCUMENTS

CN 1897077 A 1/2007
CN 101739966 A 6/2010

(Continued)

OTHER PUBLICATIONS

Korean Intellectual Property Office, Office Action, Korean Patent Application No. 10-2011-0104313, Mar. 27, 2014, five pages [with concise explanation of relevance in English].
State Intellectual Property Office of the People's Republic of China, First Office Action, Chinese Patent Application No. 201210387381.4, Jul. 18, 2014, eleven pages.

*Primary Examiner* — Kumar Patel
*Assistant Examiner* — Vinh Lam
(74) *Attorney, Agent, or Firm* — Fenwick & West LLP

(57) ABSTRACT

An organic light emitting diode display device that implements a high quality screen having uniform brightness by supplying uniform driving voltages to pixels irrespective of an external change is provided. The organic light emitting diode display device includes: an organic light emitting diode (OLED) panel comprising a plurality of pixels formed at crossings of a plurality of gate lines and a plurality of data lines of the panel; a timing controller configured to generate a plurality of control signals for driving the OLED panel; a data driver for driving the plurality of data lines; a gate driver for driving the plurality of gate lines; and a power supply unit configured to receive an input voltage and generate a stable driving voltage for driving each unit pixel of the liquid crystal panel without being affected by an instantaneous voltage rising and falling phenomenon of the input voltage.

17 Claims, 6 Drawing Sheets

(56) References Cited

U.S. PATENT DOCUMENTS

| | | | | |
|---|---|---|---|---|
| 2003/0062883 | A1* | 4/2003 | Yokogawa et al. | 323/312 |
| 2004/0263145 | A1* | 12/2004 | Umeki et al. | 323/313 |
| 2005/0151708 | A1* | 7/2005 | Farmer et al. | 345/82 |
| 2005/0243081 | A1* | 11/2005 | Cha et al. | 345/212 |
| 2006/0071703 | A1* | 4/2006 | Chatterjee et al. | 327/534 |
| 2006/0071926 | A1 | 4/2006 | Lee et al. | |
| 2006/0256050 | A1* | 11/2006 | Ikeda | 345/82 |
| 2010/0156872 | A1* | 6/2010 | Pankaj et al. | 345/211 |
| 2011/0007054 | A1* | 1/2011 | Kim | 345/211 |
| 2011/0084953 | A1* | 4/2011 | Lee et al. | 345/212 |
| 2012/0169704 | A1* | 7/2012 | Chung | 345/212 |
| 2012/0218243 | A1* | 8/2012 | Ger et al. | 345/211 |
| 2012/0236041 | A1* | 9/2012 | Oh | 345/690 |
| 2013/0016091 | A1* | 1/2013 | Kato et al. | 345/419 |
| 2013/0106823 | A1* | 5/2013 | Kishi et al. | 345/211 |

FOREIGN PATENT DOCUMENTS

| | | | |
|---|---|---|---|
| KR | 10-2003-0072996 | A | 9/2003 |
| KR | 10-2006-0114453 | A | 11/2006 |
| KR | 10-0754484 | B1 | 9/2007 |
| KR | 10-2008-0010873 | A | 1/2008 |

* cited by examiner

ORGANIC LIGHT EMITTING DIODE DISPLAY DEVICE

CROSS-REFERENCE TO RELATED APPLICATIONS

The present disclosure relates to subject matter contained in priority Korean Application No. 10-2011-0104313, filed on Oct. 12, 2011, which is herein expressly incorporated by reference in its entirety.

TECHNICAL FIELD

The embodiments disclosed herein relate to an organic light emitting diode display device and, more particularly, to an organic light emitting diode (OLED) display device capable of implementing a high quality screen having uniform brightness by supplying a uniform driving voltage to each pixel irrespective of a change in the outside.

DESCRIPTION OF THE RELATED ART

As the information society has been advancing, various requests for display devices have been increased, and recently, various flat panel displays (FPDs) such as a liquid crystal display (LCD) device, a plasma display panel (PDP), an organic light emitting diode (OLED) display device, and the like, have been utilized.

Among the flat panel displays, an OLED display device is a device in which when charges are injected into an organic light emitting layer formed between an electron injection electrode (cathode) and a hole injection electrode (anode), electrons and holes are paired to become extinct to emit light, and since the OLED display device is advantageously driven at a lower voltage (e.g., below 10V) than that of a PDP or an inorganic light emitting device, it has been actively researched.

FIG. 1 is a view illustrating a structure of an OLED display device. As illustrated in FIG. 1, in an organic light emitting device, an anode electrode 1 and a cathode electrode 3 are disposed in a facing manner with an organic light emitting layer 5 interposed there between, and light is emitted from the organic light emitting layer 5 by voltages applied to the anode electrode 1 and the cathode electrode 3. Here, the anode electrode 1 is formed as a thin film made of indium tin oxide (ITO) as a transparent conductive material smoothly supplying holes and allowing light emitted from the organic light emitting layer 5 to be well transmitted there through, and the cathode electrode is made of a metal having a low work function to smoothly supply electrons.

Thus, when a positive (+) voltage and a negative (−) voltage are applied to the anode electrode 1 and the cathode electrode 3, holes injected from the anode electrode 1 and electrons injected from the cathode electrode 3 recombines within the organic light emitting layer to emit light. Here, light emitting color varies according to a material used to form the organic light emitting layer 5. Namely, R (red), G (green), B (blue) light emitting colors are determined by the organic light emitting layer 5.

Meanwhile, in the OLED display device, unit pixels are disposed in a matrix form, and an OLED of each unit pixel is selectively driven through a driving transistor and a switching transistor provided in each unit pixel to display an image, and here, the driving transistor and the switching transistor are configured as thin film transistors.

Here, the driving transistor of each pixel of the OLED display device is operated upon receiving a uniform driving voltage from the outside, and the driving voltage is provided from a DC/DC converter mounted on a printed circuit board.

FIG. 2 is a circuit diagram of the related art DC/DC converter 10. FIG. 3 is a waveform view showing an input voltage applied to the related art DC/DC converter 10 and an output voltage output from the related art DC/DC converter 10. FIG. 4 is a view showing a problem arising as an output voltage output from the related art DC/DC converter 10 is applied to an OLED panel 20.

As shown in FIG. 2, the DC/DC converter 10 includes an inductor L11 to which a first input voltage $V_{IN1}$ is applied from the outside, a PWM controller 12 outputting a PWM signal having a uniform width, first transistor N11 and second transistors N12 operated according to the PWM signal outputted from the PWM controller 12, a band gap reference unit 14 operated according to a second input voltage $V_{IN2}$ applied from the outside, and outputting a reference voltage to a non-inverting terminal of an amplifier OP11, the amplifier OP11 having the non-inverting terminal (+) to which a reference voltage provided from the band gap reference unit 14 is applied and an inverting terminal (−) to which a second output voltage $V_{OUT}$ is fed back and applied, and outputting a certain voltage, and a third transistor N13 turned on according to the output voltage from the amplifier OP11 to output a driving voltage $V_{MID}$ to an output terminal.

As mentioned above, the related art DC/DC converter 10 is exposed to an environment in which various noise components are applied to the input terminal Thus, in order to output a uniform driving voltage $V_{MID}$ to the output terminal regardless of noise by minimizing an influence of a change in a voltage of the input terminal, the related art DC/DC converter 10 includes nose canceling units such as the band gap reference unit 14, the amplifier OP11, and the third transistor N13. Here, the driving voltage $V_{MID}$ is a voltage boosted in the DC/DC converter 10 and generated.

However, since the second input voltage $V_{IN2}$ having the same voltage level as that of the first input voltage $V_{IN1}$ applied from the outside is applied to the noise cancelling units included in the related art DC/DC converter 10, the levels of the two voltages may be changed in the input terminals.

Thus, as indicated by A1 and A2 in FIG. 3, the output voltage output from the related art DC/DC converter 10 may fluctuate due to an instantaneous change in the first and second input voltages $V_{IN1}$ and $V_{IN2}$ applied from the outside, and as the output voltage is applied to the driving transistors forming the unit pixels, the screen of the OLED panel 20 has non-uniform brightness, which results in a failure of implementing a high quality screen.

SUMMARY

The embodiments disclosed herein provide an organic light emitting diode display device capable of implementing a high quality screen having uniform brightness by supplying uniform driving voltages to respective pixels irrespective of an external change.

According to one embodiment, there is provided an organic light emitting diode display device including: an organic light emitting diode (OLED) panel in which a plurality of gate lines and a plurality of data lines are formed and a plurality of pixels are formed at crossings of the gate lines and the data lines; a timing controller configured to generate a plurality of control signals for driving the OLED panel; a data driver for driving the plurality of data lines; a gate driver for driving the plurality of gate lines; and a power supply unit configured to receive an input voltage from the outside and generate a stable driving voltage for driving each unit pixel of the liquid crystal panel without being affected by an instantaneous voltage rising and falling phenomenon of the input voltage.

The power supply unit may include: a power stabilizing unit configured to generate a first output voltage upon receiving the input voltage; and a noise canceling unit configured to generate a second output voltage without a noise component upon receiving the first output voltage.

The power stabilizing unit may include: a voltage generating unit configured to receive the second output voltage output from the noise canceling unit and generate a first reference voltage; and a voltage selecting unit configured to receive the input voltage, the first reference voltage, and the second output voltage, and generate a first output voltage.

The first reference voltage may have the same voltage value as the first output voltage from the power stabilizing unit.

The voltage selecting unit may receive the input voltage, the first reference voltage, and the second output voltage, and when the second output voltage is lower than a target voltage, the voltage selecting unit may output the input voltage as the first output voltage.

The voltage selecting unit may output the input voltage as the first output voltage in an initial boosting section.

The initial boosting section may range from 2 ms to 16 ms according to one embodiment.

The voltage selecting unit may receive the input voltage, the first reference voltage, and the second output voltage, and when the second output voltage is higher than the target voltage, the voltage selecting unit may output the first reference voltage as the first output voltage.

The voltage selecting unit may output the first reference voltage as the first output voltage in the other remaining section excluding the initial boosting section.

The noise canceling unit may include: a band gap reference unit configured to receive the first output voltage and generate a second reference voltage; an amplifier connected to the band gap reference unit and configured to have a non-inverting terminal to which the second reference voltage is applied and an inverting terminal to which the second output voltage is applied, to generate a comparison voltage; a third transistor connected to the amplifier, having a drain to which a driving voltage is applied and a source connected to an output terminal, and turned on according to the comparison voltage to output the driving voltage to the output terminal; first and second resistors connected in series to the output terminal; and a bypass capacitor connected to the output terminal to cancel a noise component of the output voltage.

A resistance value of the first resistor may be greater than that of the second resistor.

According to one embodiment, there is provided an organic light emitting diode display device including: an organic light emitting diode (OLED) panel in which a plurality of gate lines and a plurality of data lines are formed and a plurality of pixels are formed at crossings of the gate lines and the data lines; a timing controller configured to generate a plurality of control signals for driving the OLED panel; a data driver for driving the plurality of data lines; a gate driver for driving the plurality of gate lines; a voltage generating unit configured to receive a first voltage and generate a first reference voltage; a voltage selecting unit configured to receive the first voltage, the first reference voltage, and an input voltage and generate a first output voltage; a band gap reference unit configured to receive the first output voltage and generate a second reference voltage; an amplifier connected to the band gap reference unit and configured to have a non-inverting terminal to which the second reference voltage is applied and an inverting terminal to which the second output voltage is applied, to generate a comparison voltage; an output transistor connected to the amplifier, having a drain to which a driving voltage is applied and a source connected to an output terminal, and turned on according to the comparison voltage to output the driving voltage to the output terminal; first and second resistors connected in series to the output terminal; and a power supply unit including a bypass capacitor connected to the output terminal to cancel a noise component of the output voltage.

Figure 1:
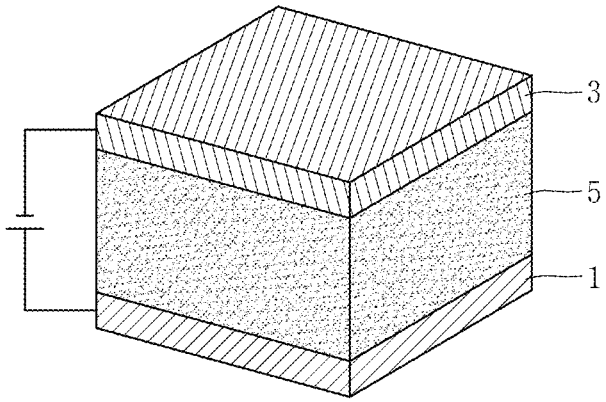
FIG. 1 is a view schematically illustrating a structure of an organic light emitting diode (OLED).
Figure 2:
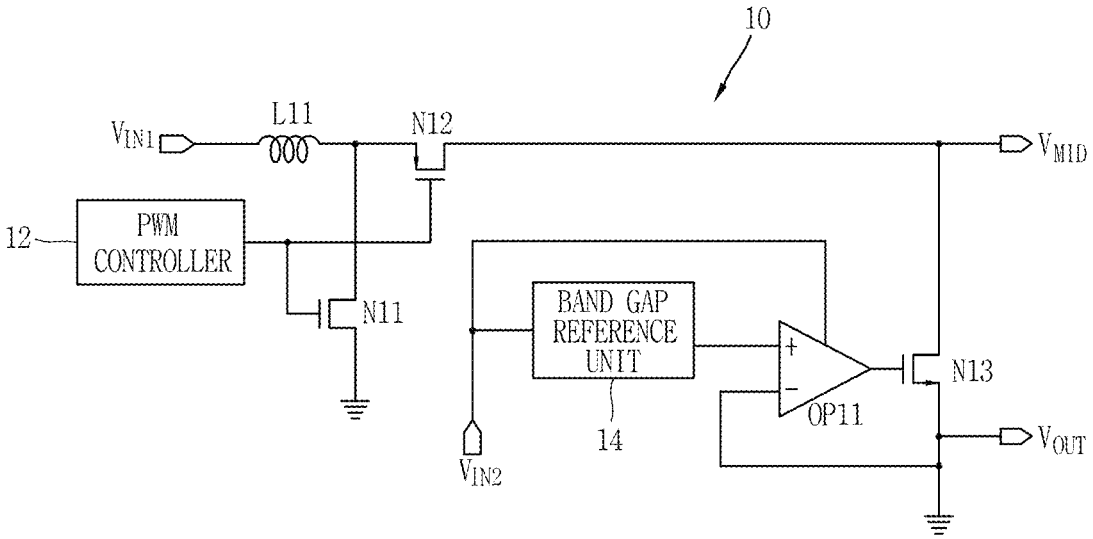
FIG. 2 is a circuit diagram of the related art DC/DC converter.

The drawings depict, and the detail description describes, various non-limiting embodiments for purposes of illustration only. One skilled in the art will readily recognize from the following discussion that alternative embodiments of the structures and methods illustrated herein may be employed without departing from the principles described herein

DETAILED DESCRIPTION

An organic light emitting diode (OLED) display device according to the embodiments disclosed herein will be described in detail with reference to the accompanying drawings. This invention may, however, be embodied in many different forms and should not be construed as limited to the embodiments set forth herein. Like reference numerals designate like elements throughout the specification. In the following description, if it is decided that the detailed description of known function or configuration related to the invention makes the subject matter of the invention unclear, the detailed description is omitted.

Figure 5:
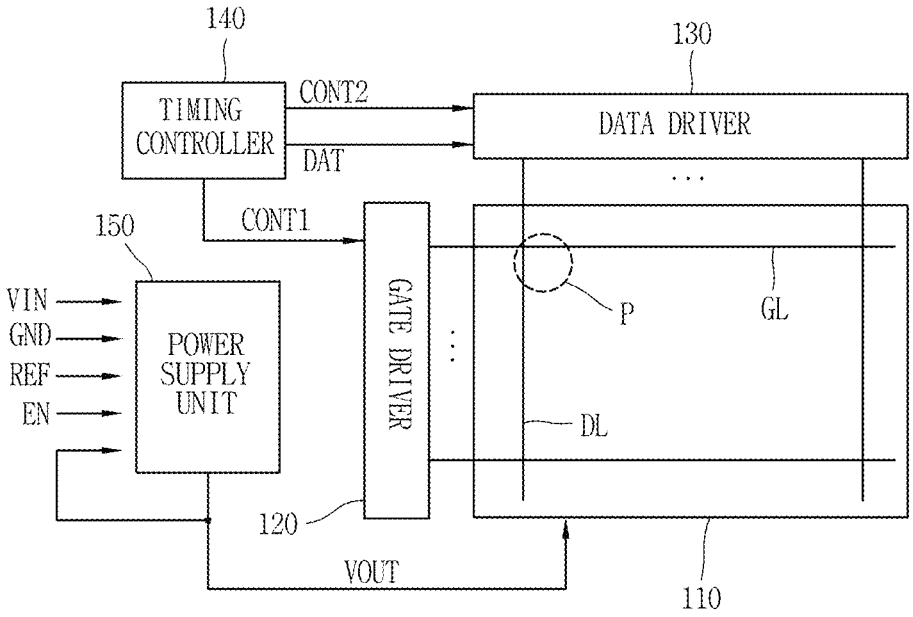
FIG. 5 is a view illustrating an OLED display device according to one embodiment.
Figure 6:
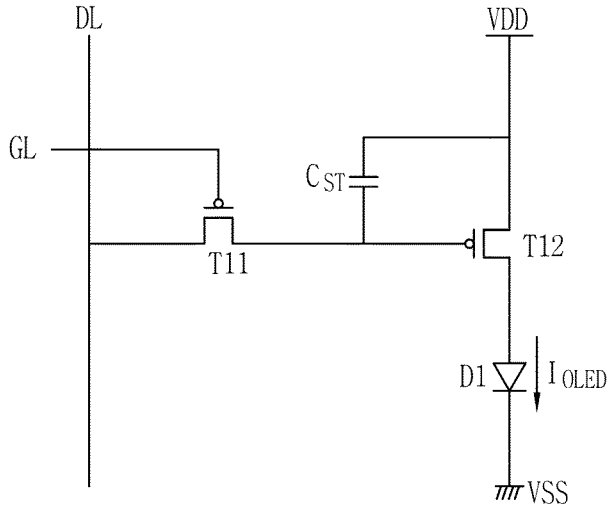
FIG. 6 is a view illustrating each unit pixel according to one embodiment.

FIG. 5 is a view illustrating an OLED display device according to one embodiment, and FIG. 6 is a view illustrating each unit pixel according to one embodiment.

As illustrated in FIG. 5, when viewed from the equivalent circuit, an OLED panel 110 includes a plurality of display signal lines GL and DL and a plurality of unit pixels connected to the signal lines GL and DL and arranged in a matrix form.

Here, the display signal lines GL and DL include a plurality of gate lines GL transferring gate signals and a plurality of data lines DL transferring data signals. The gate lines GL extend in a row direction and are substantially parallel to each other, and the data lines D1 extend in a column direction and are substantially parallel to each other.

As illustrated in FIG. 6, in each unit pixel, first and second thin film transistors (TFTs) are provided in a region divided by a gate line GL supplying a gate signal and a data line supplying a data signal. Here, the gate line GL and the data line DL are perpendicular, and an OLED D1 is provided near the crossing of the gate line GL and the data line DL.

Here, a gate of the first TFT T11, operating as a switching element, is connected to the gate line GL, a source of the first TFT T11 is connected to a gate of the second TFT T12, and a drain of the first TFT T11 is connected to the data line DL.

The gate of the second TFT T12, operating as a driving element for driving the OLED D1, is connected to the source of the first TFT T11 and one side of a capacitor Cst, a source of the second TFT T12 is connected to a driving voltage VDD, and a drain of the second TFT T12 is connected to an anode of the OLED D1.

Here, the first and second TFTs T11 and T12 may be formed as a PMOS or NMOS transistor.

One side of the capacitor Cst is connected to the source of the first TFT T11 and the gate of the second TFT T12, and the other side of the capacitor Cst is connected to the driving voltage VDD.

The anode of the OLED D1 is connected to the drain of the second TFT T12, and a cathode of the second TFT T12 is connected to a ground voltage VSS. Here, an organic light emitting layer is provided between the anode and the cathode of the OLED D1. The organic light emitting layer may include, for example, a hole injection layer, a hole transporting layer, an emission layer, an electron transporting layer, and an electron injection layer. Also, the organic light emitting layer may include, for example, an electron injection layer, an electron transporting layer, an emission layer, a hole transporting layer, and a hole injection layer.

As for an operation of each unit pixel, the first TFT T11 is turned on by a gate signal supplied to the gate line GL, so a difference voltage between a data signal supplied to the data line DL and the driving voltage VDD is charged in the capacitor Cst. The second TFT T12 supplies a driving current $I_{OLED}$ according to the difference voltage charged in the capacitor Cst to make the OLED D1 emit light, and the OLED D1 represents gradation proportional to the driving current $I_{OLED}$.

Referring back to FIG. 5, the gate driver 120 is connected to the gate line GL of the OLED panel 110 and applies a gate signal as a combination of a gate ON voltage Von and a gate OFF voltage Voff to the gate line GL. Here, the gate driver 120 may be formed together on the OLED panel 110 during a TFT fabricating process.

The data driver 130 is connected to the data line DL of the OLED panel 110, generates a plurality of gray scale voltages based on a plurality of gamma voltages provided from a gamma voltage generating unit (not shown), selects the generated gray voltages and applies them as data signals to unit pixels. The data driver 130 generally includes a plurality of integrated circuits.

The timing controller 140 generates control signals CONT1 and CONT2 for controlling an operation of the gate driver 120, the data driver 130, and the like, and provides the corresponding control signals to the gate driver 120 and the data driver 130.

The power supply unit 150 receives the input voltage VIN and outputs the driving voltage VDD (i.e., VOUT) for driving the driving transistors T12 of the respective unit pixels. Here, the power supply unit 10 outputs a uniform driving voltage regardless of a change in the outside, and the driving voltage is applied to the driving transistors T12 provided in the respective unit pixels of the OLED panel 110, thus implementing a screen of the OLED panel 110 to have uniform brightness. Thus, an OLED display device having a high quality screen may be implemented. Details thereof will be described in detail with reference to FIGS. 7 to 10.

Although not shown, a driving voltage generating unit generates a plurality of driving voltages. For example, the driving voltage generating unit generates a gate ON voltage (Von), a gate OFF voltage (Voff), and the like.

Hereinafter, a display operation of the OLED display device will be described in more detail.

The timing controller 140 is provided with an RGB image signal (R, G, B), control signals for controlling a display of the RGB image signal, e.g., a vertical synchronization signal Vsync, a horizontal synchronization signal Hsync, a main clock MCLK, a data enable signal DE, and the like, from an external graphic controller (not shown). The timing controller 140 generates the gate control signal CONT1 and the data control signal CONT2 based on the provided control signals, appropriately processes the image signal (R, G, B) according to operational conditions of the OLED panel 110, provides the gate control signal CONT1 to the gate driver 120 and provides the data control signal CONT2 and the processed image signal DAT to the data driver 130.

Here, the gate control signal CONT1 includes a gate modulation control signal FLK, a gate output enable signal GOE, a gate shift clock signal GSC, and a gate start pulse-up signal GSP.

The data control signal CONT2 includes a source output enable signal SOE, a source shift clock signal SSC, a source start pulse right SSPR, a source start pulse left SSPL, and a polarity control signal POL.

The data driver 130 sequentially receives image data DAT corresponding to one row of unit pixels according to the data control signal CONT2 from the timing controller 140, and selects a gray voltage corresponding to each image data DAT from among gray voltages, thus converting the image data DAT into a corresponding data voltage.

The gate driver 120 applies a gate ON voltage Von to the gate line GL according to the gate control signal CONT1 from the timing controller 140 to turn on the switching element T11 connected to the gate line GL.

During a period in which one row of the switching elements T11 are turned on as the gate ON voltage Von is applied to one gate line GL (the period is called '1H' or '1 horizontal period', which is the same as one period of the horizontal synchronization signal Hsync, the data enable signal DE, and a gate clock CPV), the data driver 130 supplies respective data voltage to the corresponding data lines DL. The data voltages supplied to the data lines DL are applied to corresponding unit pixels through the turned-on switching elements T11.

In this manner, the gate ON voltage Von is sequentially applied to all the gate lines GL during one frame, thus applying a data voltage to every unit pixel.

Figure 7:
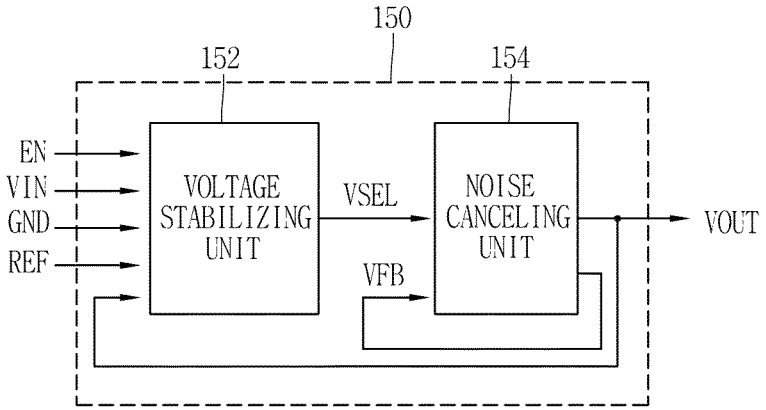
FIG. 7 is an internal block diagram of a power supply unit according one embodiment.
Figure 8:
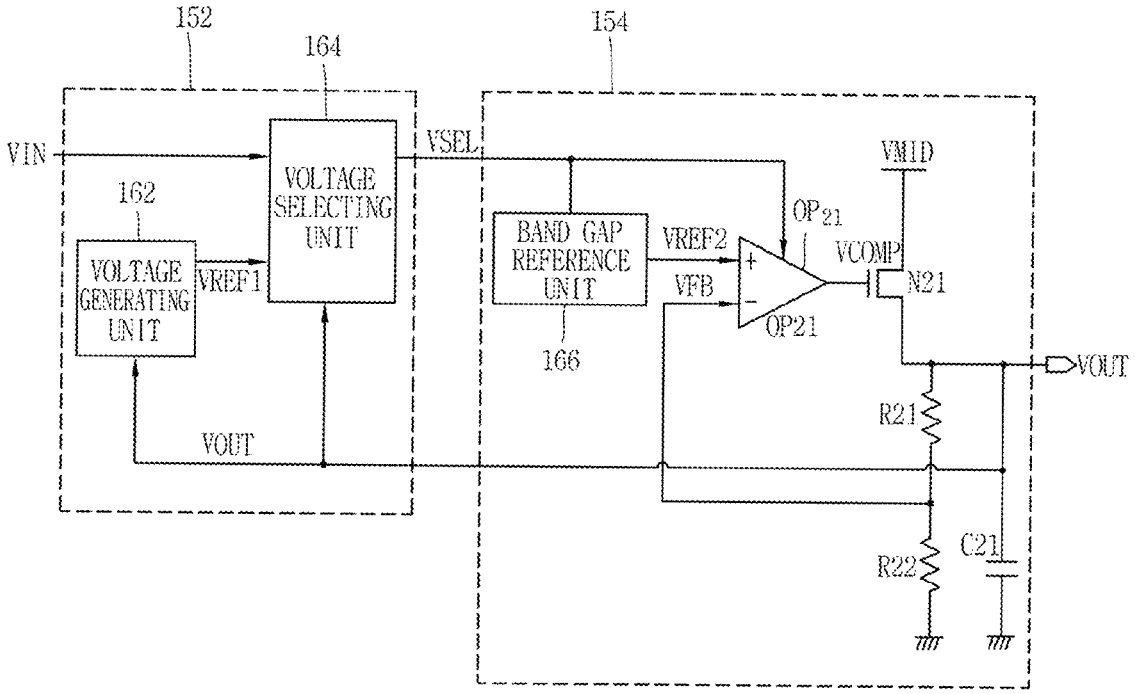
FIG. 8 is a circuit diagram of a voltage stabilizing unit and a noise canceling unit of FIG. 7 according to one embodiment.
Figure 9:
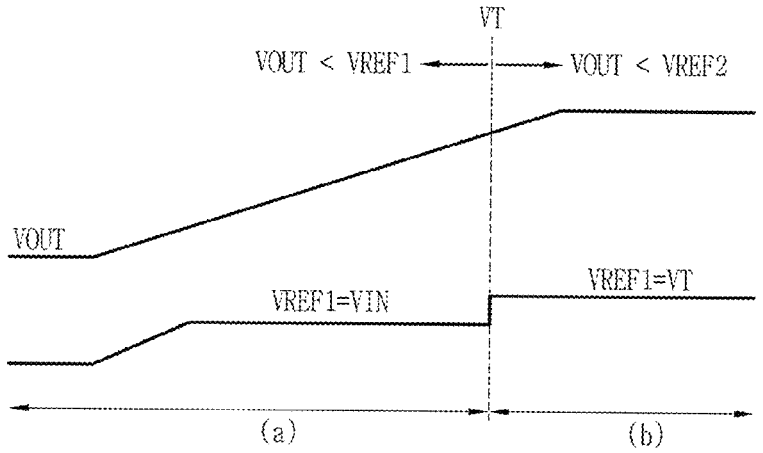
FIG. 9 is a view illustrating an operation of the voltage stabilizing unit of FIG. 8 according to one embodiment.
Figure 10:
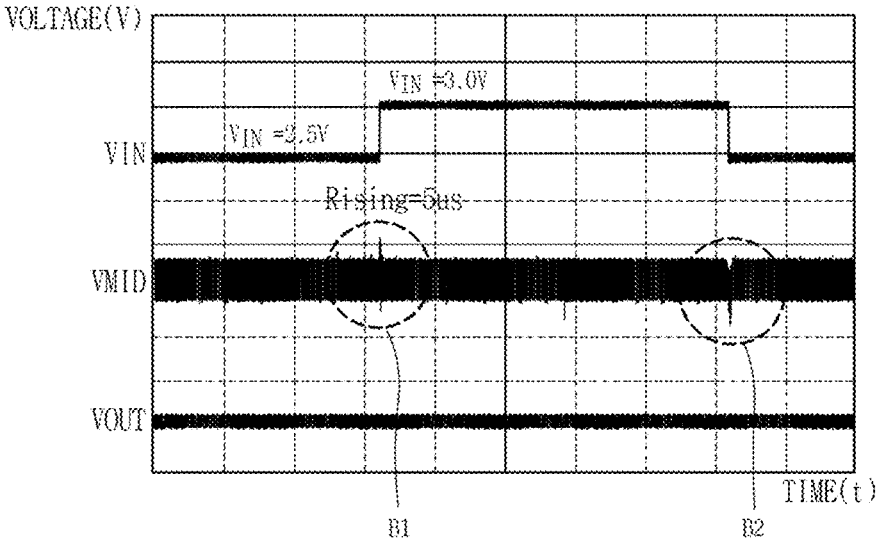
FIG. 10 is a waveform view showing an input voltage, a driving voltage, and an output voltage according to one embodiment.

FIG. 7 is an internal block diagram of the power supply unit 150 according to one embodiment. FIG. 8 is a circuit diagram of a voltage stabilizing unit 152 and a noise canceling unit 154 of FIG. 7 according to one embodiment. FIG. 9 is a view illustrating an operation of the voltage stabilizing unit 152 of FIG. 8 according to one embodiment. FIG. 10 is a waveform view showing an input voltage, a driving voltage, and an output voltage.

As illustrated in FIGS. 7 and 8, the power supply unit 150 according to one embodiment receives the input voltage VIN, a ground voltage GND, a reference voltage REF, an enable signal EN, and a second output voltage VOUT, and outputs a driving voltage VDD, i.e., the second output voltage VOUT, to be applied to the source of the driving transistor T12 provided in each unit pixel.

Here, the input voltage VIN may be, for example, a battery voltage of a portable phone, having a voltage ranging from 2.5 to 4.5V. The reference voltage REF may be, for example, 1.2V, and the enable signal EN is provided from the data driver 130, and the second output voltage VOUT is an output voltage output from the noise canceling unit 154.

Also, the power supply unit 150 includes a voltage stabilizing unit 152 that receives the input voltage VIN from the outside and outputs a first output voltage VSEL and a noise canceling unit 154 that receives the first output voltage VSEL provided from the voltage stabilizing unit 152 and outputs a second output voltage VOUT without a noise component.

Here, in order to output the stabilized first output voltage VSEL, the voltage stabilizing unit 152 includes a voltage generating unit 162 and a voltage selecting unit 164 as shown in FIG. 8.

Here, the voltage generating unit 162 receives the second output voltage VOUT output from the noise canceling unit 154 and outputs a first reference voltage VREF1, and in this case, the first reference voltage VREF1 may have the same voltage value as that of the first output voltage VSEL, and the reason is as follows.

As illustrated in FIG. 9, after the input voltage VIN is applied to the voltage stabilizing unit 152 from the outside, the first output voltage VSEL of the voltage stabilizing unit 152 has a voltage value lower than a target voltage VT, so the input voltage VIN is lower than the target voltage VT. In this case, the voltage stabilizing unit 152 cannot stably operate. An internal circuit is required to use the input voltage VIN during the initial boosting section (a), for which, the voltage selecting unit 164 is provided in the present embodiment. In this case, the initial boosting section (a) may be set to, for example, 2ms~16ms.

The voltage selecting unit 164 receives the input voltage VIN, the second output voltage VOUT from the power supply unit 150 (not shown), and the first reference voltage VREF1 from the voltage generating unit 162, and when the second output voltage VOUT is lower than the target voltage VT, the voltage selecting unit 614 outputs the input voltage VIN as the first output voltage VSEL of the voltage generating unit 162. Here, the target voltage VT may have the same voltage value as that of the first reference voltage VREF1. However, when the second output voltage VOUT is higher than the target voltage VT, the voltage selecting unit 164 outputs the first reference voltage VREF1 as the first output voltage VSEL of the voltage selecting unit 164.

As mentioned above, the voltage selecting unit 164 uses the output voltage from the noise canceling unit 154, i.e., the second output voltage VOUT, as the input voltage VIN of the voltage selecting unit 164 only in the initial boosting section (a), and thereafter, the voltage selecting unit 164 uses the first reference voltage VREF1 output from the voltage generating unit 162, as the input voltage VIN.

When the first output voltage VSEL, i.e., the target voltage VT, is generated by using the internal voltage generating unit 162 and the voltage selecting unit 164 in the voltage stabilizing unit 152, the generated first output voltage VSEL is provided to the noise canceling unit 154.

The noise canceling unit 154 receives the first output voltage VSEL provided form the voltage stabilizing unit 152 and outputs the second output voltage VOUT, i.e., the driving voltage VDD to be applied to the source of the driving transistor T12 provided in each unit pixel, through an output terminal.

Also, the noise canceling unit 154 includes a band gap reference unit 166 configured to receive the first output voltage provided from the voltage stabilizing unit 152 and output the second reference voltage VREF2, an amplifier OP21 configured to have a non-inverting terminal to which the second reference voltage VREF2 is applied and an inverting terminal to which the feedback second output voltage VFB is applied, to generate a comparison voltage VCOMP, a third transistor N21 having a drain to which the driving voltage VMID is applied and a source connected to an output terminal, and turned on according to the comparison voltage VCOMP to output the driving voltage VMID, first and second resistors R21 and R22 connected in series to the output terminal, and a bypass capacitor C21 connected to the output terminal.

The band gap reference unit 166 receives the first output voltage VSEL provided from the voltage stabilizing unit 152 and outputs the second reference voltage VREF2, and the second reference voltage VREF2 output in this case is applied to the non-inverting terminal (+) of the amplifier OP21 connected to a rear stage of the band gap reference unit 155 and compared with the feedback second output voltage VFB output from the output terminal of the noise canceling unit 154. In this case, the second reference voltage VREF2 may be, for example, 1.2V. Here, the feedback second output voltage VFB represents a feedback voltage lowered by a predetermined rate by the first and second resistors R21 and R22.

The amplifier OP21 includes the non-inverting terminal (+) and the inverting terminal (−), and operates upon receiving the first output voltage VSEL provided from the voltage stabilizing unit 152. Here, the second reference voltage VREF2 provided from the band gap reference unit 166 is applied to the non-inverting terminal (+), and the feedback second output voltage VFB fed back from the noise canceling unit 154 is applied to the inverting terminal (−). Accordingly, the amplifier OP21 compares the second reference voltage VREF2 and the feedback second output voltage VFB and outputs the comparison voltage VCOMP corresponding to a compression result to the output terminal.

Here, the output voltage of the amplifier OP21, i.e., the comparison voltage VCOMP, is applied to the third transistor N21, and the third transistor N21 is turned on by the comparison voltage VCOMP to output the driving voltage VMID applied to the drain of the third transistor N21 is output to the output terminal Here, the source of the third transistor N21 is connected to the output terminal, and the first and second resistors R21 and R22 are connected in series to the output terminal Here, a resistance ratio of the first and second resistors R21 and R22 may be set, for example, to 9:1, and may be set to different resistance rations to obtain a voltage value having a desired level in the output terminal. Also, the bypass capacitor C21 is connected to the output terminal and serves to cancel a noise component of the second output voltage VOUT output from the output terminal FIG. 10 is a waveform view showing an input voltage, a driving voltage, and an output voltage.

Figure 3:
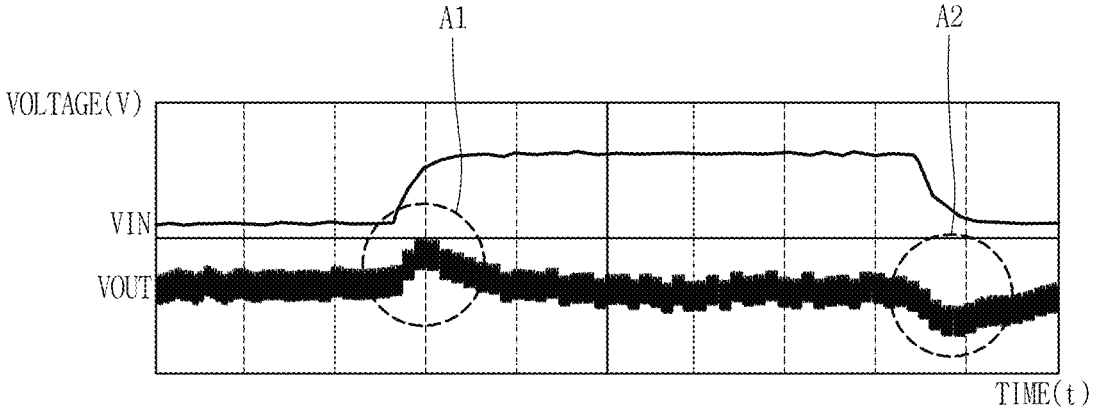
FIG. 3 is a waveform view showing an input voltage applied to the related art DC/DC converter and an output voltage output from the related art DC/DC converter.
Figure 4:
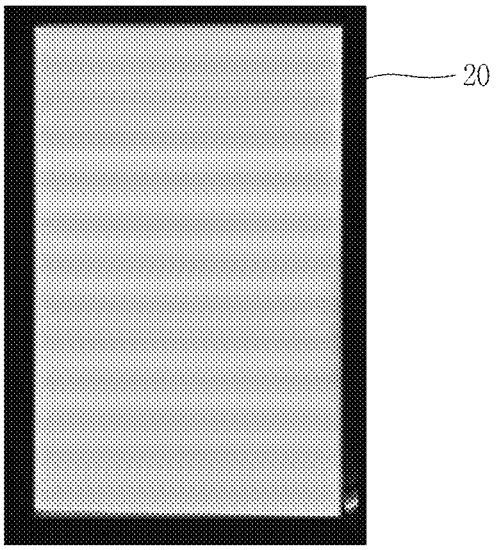
FIG. 4 is a view showing a problem arising as an output voltage output from the related art DC/DC converter is applied to the organic light emitting device panel.

As shown in FIG. 3, in the related art, the output voltage output from the related art DC/DC converter 10 jitters due to an instantaneous change of the input voltage applied from the outside, and since the output voltage is applied to the driving transistors forming the respective unit pixels, the screen of the OLED panel has non-uniform brightness, resulting in a failure of implementing a high quality screen.

However, as shown in FIG. 10, since the power supply unit 150 includes the power stabilizing unit 152 and the noise canceling unit 154, although the input voltage VIN and the driving voltage VMID instantly rises (B1) or falls (B2), the output voltage VOUT is not affected. Here, the driving voltage VMID is a voltage generated upon being boosted in the power supply unit 150, so it is affected by an instantaneous change of the input voltage VIN.

Here, although the input voltage VIN jitters due to an instantaneous change in the rising edge and the falling edge, the output voltage VOUT is not affected. Thus, since the output voltage VOUT is applied as a driving voltage to the driving transistors forming the respective unit pixels, the screen of the OLED panel can have uniform brightness, and thus, the OLED display device having a high quality screen can be implemented.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode display device comprising:

an organic light emitting diode (OLED) panel in which a plurality of gate lines and a plurality of data lines are formed and a plurality of pixels are formed at crossings of the gate lines and the data lines;

a timing controller configured to generate a plurality of control signals for driving the OLED panel;

a data driver for driving the plurality of data lines;

a gate driver for driving the plurality of gate lines; and a power supply unit configured to receive an input voltage from the outside and generate a stable driving voltage for driving each unit pixel of the OLED panel without being affected by an instantaneous voltage rising and falling phenomenon of the input voltage, the power supply unit comprising:

a power stabilizing unit configured to generate a first output voltage upon receiving the input voltage; and a noise canceling unit configured to generate a second output voltage without a noise component upon receiving the first output voltage, wherein the power stabilizing unit comprises:

a voltage generating unit configured to receive the second output voltage output from the noise canceling unit and to generate a first reference voltage and, a voltage selecting unit configured to receive the input voltage, the first reference voltage, and the second output voltage and to generate the first output voltage.

2. The device of claim 1, wherein the first reference voltage has the same voltage value as the first output voltage from the power stabilizing unit.

3. The device of claim 1, wherein the voltage selecting unit receives the input voltage, the first reference voltage, and the second output voltage, and when the second output voltage is lower than a target voltage, the voltage selecting unit outputs the input voltage as the first output voltage.

4. The device of claim 3, wherein the voltage selecting unit outputs the input voltage as the first output voltage in an initial boosting section.

5. The device of claim 4, wherein the initial boosting section ranges from 2 ms to 16 ms.

6. The device of claim 1, wherein the voltage selecting unit receives the input voltage, the first reference voltage, and the second output voltage, and when the second output voltage is higher than the target voltage, the voltage selecting unit outputs the first reference voltage as the first output voltage.

7. The device of claim 6, wherein the voltage selecting unit outputs the first reference voltage as the first output voltage in the other remaining section excluding the initial boosting section.

8. An organic light emitting diode display device comprising:

an organic light emitting diode (OLED) panel in which a plurality of gate lines and a plurality of data lines are formed and a plurality of pixels are formed at crossings of the gate lines and the data lines;

a timing controller configured to generate a plurality of control signals for driving the OLED panel;

a data driver for driving the plurality of data lines;

a gate driver for driving the plurality of gate lines; and a power supply unit configured to receive an input voltage from the outside and generate a stable driving voltage for driving each unit pixel of the OLED panel without being affected by an instantaneous voltage rising and falling phenomenon of the input voltage, the power supply unit comprising:

a power stabilizing unit configured to generate a first output voltage upon receiving the input voltage; and a noise canceling unit configured to generate a second output voltage without a noise component upon receiving the first output voltage, the noise canceling unit comprising:

a band gap reference unit configured to receive the first output voltage and generate a second reference voltage;

an amplifier connected to the band gap reference unit and configured to have a non-inverting terminal to which the second reference voltage is applied and an inverting terminal to which the second output voltage is applied, to generate a comparison voltage;

a third transistor connected to the amplifier, having a drain to which a driving voltage is applied and a source connected to an output terminal, and turned on according to the comparison voltage to output the driving voltage to the output terminal;

first and second resistors connected in series to the output terminal; and a bypass capacitor connected to the output terminal to cancel a noise component of the output voltage.

9. The device of claim 8, wherein a resistance value of the first resistor is greater than that of the second resistor.

10. An organic light emitting diode display device comprising:

an organic light emitting diode (OLED) panel in which a plurality of gate lines and a plurality of data lines are formed and a plurality of pixels are formed at crossings of the gate lines and the data lines;

a timing controller configured to generate a plurality of control signals for driving the OLED panel;

a data driver for driving the plurality of data lines;

a gate driver for driving the plurality of gate lines;

a voltage generating unit configured to receive a first voltage and generate a first reference voltage;

a voltage selecting unit configured to receive the first voltage, the first reference voltage, and an input voltage and generate a first output voltage;

a band gap reference unit configured to receive the first output voltage and generate a second reference voltage;

an amplifier connected to the band gap reference unit and configured to have a non-inverting terminal to which the second reference voltage is applied and an inverting terminal to which the second output voltage is applied, to generate a comparison voltage;

an output transistor connected to the amplifier, having a drain to which a driving voltage is applied and a source connected to an output terminal, and turned on according to the comparison voltage to output the driving voltage to the output terminal;

first and second resistors connected in series to the output terminal; and a power supply unit including a bypass capacitor connected to the output terminal to cancel a noise component of the output voltage.

11. An apparatus comprising:

an organic light emitting diode (OLED) panel having a plurality of pixels;

a driving unit configured to generate a plurality of control signals for driving the OLED panel; and a power supply unit having a first output voltage generating unit, that generates a first output voltage by using an input voltage and a first reference voltage, and a second output voltage generating unit, that generates a second output voltage without a noise component upon receiving the first output voltage, wherein the first output voltage generating unit comprises:

a voltage generating unit configured to receive the second output voltage output from a noise canceling unit and generate the first reference voltage; and a voltage selecting unit configured to receive the input voltage, the first reference voltage, and the second output voltage, and generate the first output voltage.

12. The apparatus of claim 11, wherein the first reference voltage has the same voltage value as the first output voltage.

13. The apparatus of claim 11, wherein the voltage selecting unit receives the input voltage, the first reference voltage, and the second output voltage, and when the second output voltage is lower than a target voltage, the voltage selecting unit outputs the input voltage as the first output voltage, wherein the voltage selecting unit outputs the input voltage as the first output voltage in an initial boosting section, and wherein the initial boosting section ranges from 2 ms to 16 ms.

14. The apparatus of claim 11, wherein the voltage selecting unit receives the input voltage, the first reference voltage, and the second output voltage, and when the second output voltage is higher than the target voltage, the voltage selecting unit outputs the first reference voltage as the first output voltage, wherein the voltage selecting unit outputs the first reference voltage as the first output voltage in the other remaining section excluding the initial boosting section.

15. An apparatus comprising:

a power source configured to receive an input voltage and to generate a driving voltage used in driving pixels of an organic light emitting diode (OLED) panel without being affected by an instantaneous voltage rise or fall of said input voltage, said power source comprising:

a voltage stabilizer configured to generate a first output voltage upon receiving said input voltage; and a noise canceller configured to generate a second output voltage without a noise component upon receiving said first output voltage, wherein said voltage stabilizer comprises, a voltage generator configured to receive said second output voltage output from said noise canceller and to generate a first reference voltage, and a voltage selector configured to receive said input voltage, said first reference voltage and said second output voltage, and to generate said first output voltage.

16. The apparatus of claim 15, wherein said first reference voltage has the same voltage value as said first output voltage from said power stabilizer, wherein said voltage selector receives said input voltage, said first reference voltage, and said second output voltage, and when said second output voltage is lower than a target voltage, said voltage selector outputs said input voltage as said first output voltage, and wherein said voltage selector receives said input voltage, said first reference voltage, and said second output voltage, and when said second output voltage is higher than said target voltage, said voltage selector outputs said first reference voltage as said first output voltage.

17. An apparatus comprising:

an organic light emitting diode (OLED) panel having gate lines, data lines and a plurality of pixels, said OLED panel configured to receive, via said gate lines and said data lines, a plurality of control signals from a data driver and a gate driver under control of a timing controller, said OLED panel further configured to receive a uniform driving voltage generated by a power source that is configured to receive an input voltage, which undergoes voltage stabilization using a voltage generating unit and a voltage selection unit, and undergoes noise cancellation using a band gap reference unit and comparator, said received driving voltage to be used in driving said pixels of said OLED panel without being affected by an instantaneous rise or fall of said input voltage, such that uniform brightness is achieved across the OLED panel.

* * * * *